US011629924B2

(12) United States Patent
Razpet

(10) Patent No.: US 11,629,924 B2
(45) Date of Patent: Apr. 18, 2023

(54) RIFLE

(71) Applicant: Tomaž Razpet, Cerkno (SI)

(72) Inventor: Tomaž Razpet, Cerkno (SI)

( * ) Notice: Subject to any disclaimer, the term of this patent is extended or adjusted under 35 U.S.C. 154(b) by 74 days.

(21) Appl. No.: 17/599,011

(22) PCT Filed: Feb. 27, 2020

(86) PCT No.: PCT/IB2020/051665
§ 371 (c)(1),
(2) Date: Sep. 28, 2021

(87) PCT Pub. No.: WO2020/201848
PCT Pub. Date: Oct. 8, 2020

(65) Prior Publication Data

US 2022/0146221 A1 May 12, 2022

(30) Foreign Application Priority Data

Mar. 29, 2019 (SI) ..... SIP-201900066

(51) Int. Cl.
*F41A 5/18* (2006.01)
*F41A 5/20* (2006.01)

(52) U.S. Cl.
CPC . *F41A 5/18* (2013.01); *F41A 5/20* (2013.01)

(58) Field of Classification Search
CPC ..... F41A 5/18; F41A 5/20; F41A 5/22; F41A 5/24; F41A 5/28
See application file for complete search history.

(56) References Cited

U.S. PATENT DOCUMENTS 1,430,661 A * 10/1922 Lewis ..... F41A 13/02 89/193
2,951,424 A * 9/1960 Stoner ..... F41A 3/16 89/185
3,443,477 A * 5/1969 Kaempfarthur ..... F41A 5/28 89/193
3,618,457 A * 11/1971 Miller ..... F41A 3/26 89/185

(Continued)

FOREIGN PATENT DOCUMENTS

WO 1999005467 A1 2/1999

OTHER PUBLICATIONS

International Search Report issued in PCT/IB2020/051665; dated Jun. 9, 2020.

*Primary Examiner* — Joshua E Freeman
(74) *Attorney, Agent, or Firm* — Studebaker & Brackett PC

(57) ABSTRACT

A rifle with an auto-loading mechanism having a gas chamber with a guiding tube connected to a gas adapter, and a piston assembly including an impact damper, a piston slidingly movable within the gas chamber, a guide fixed to the piston at one end and provided at its other end with a blind hole, a fixed piston slidingly movable at one end within the blind hole of the guide and fixed to the impact damper at the other end, a helical spring arranged within the blind hole of the guide and a return helical spring arranged around the guide in a way to lean against a stop in the guiding sleeve with one end and against the impact damper with the other end, wherein the gas chamber is arranged on the rifle barrel in the area of the barrel receiver. The advantage of the rifle lies in that it allows for more accurate shooting, has lower weight and less recoils.

9 Claims, 4 Drawing Sheets

(56) References Cited

Figure 1:
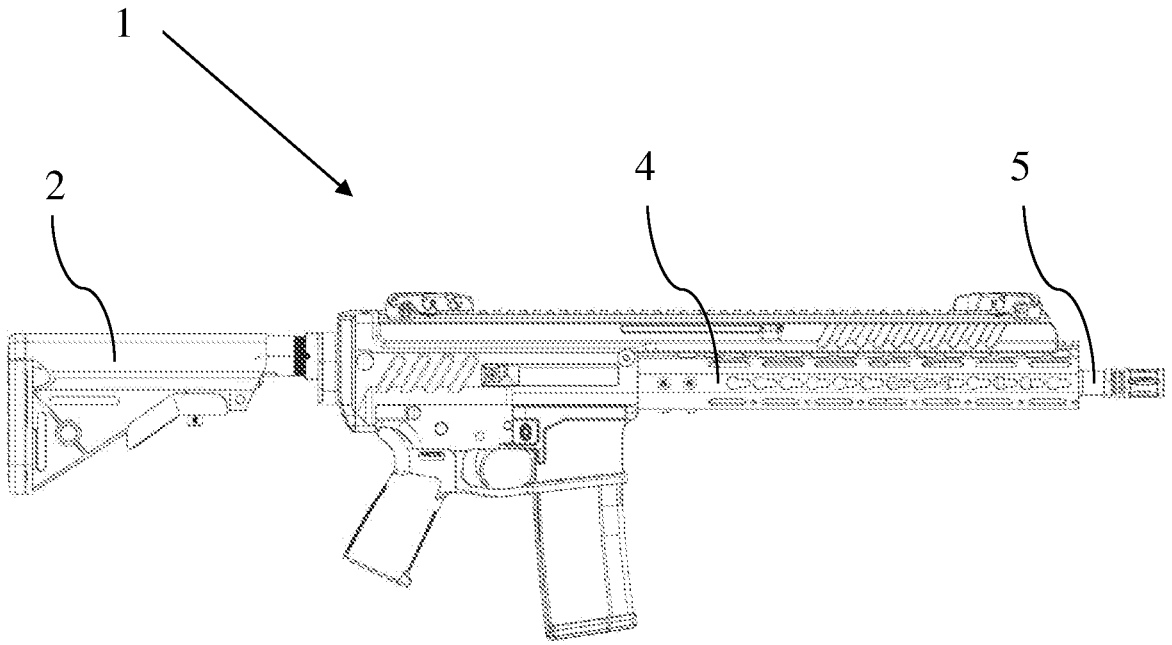

U.S. PATENT DOCUMENTS 3,675,534 A * 7/1972 Beretta ..... F41A 3/72 89/185
3,776,096 A * 12/1973 Donovan ..... F41A 3/26 89/142
4,416,186 A * 11/1983 Sullivan ..... F41A 3/66 89/198
4,475,438 A * 10/1984 Sullivan ..... F41A 3/82 89/185
4,553,469 A * 11/1985 Atchisson ..... F41A 35/02 42/25
5,177,320 A * 1/1993 Reynolds ..... F41A 5/18 89/193
5,886,281 A * 3/1999 Kirstein ..... F41A 5/18 89/187.01
5,983,774 A * 11/1999 Mihaita ..... F41G 1/28 42/137
8,752,472 B1 * 6/2014 Lukman ..... F41A 3/66 89/198
10,323,891 B1 * 6/2019 Zheng ..... F41A 3/84
2011/0271827 A1 11/2011 Larson et al.
2013/0055883 A1 * 3/2013 Cassels ..... F41A 5/28 89/193
2014/0224114 A1 * 8/2014 Faxon ..... F41A 5/28 89/193
2015/0090109 A1 * 4/2015 Parsadayan ..... F41A 5/26 89/191.01
2015/0323270 A1 * 11/2015 Winge ..... F41A 3/36 89/193
2016/0178299 A1 * 6/2016 Cassels ..... F41A 5/28 89/193
2017/0234634 A1 * 8/2017 Hirt ..... F41A 5/18 89/193
2018/0259276 A1 9/2018 Doll et al.

* cited by examiner

RIFLE

FIELD OF INVENTION

The invention relates to a rifle, particularly a semi-automatic, automatic or assault rifle.

PRIOR ART

A rifle disclosed in WO1999005467 A1 is known from prior art. It uses the so-called AK platform (Kalashnikov automatic weapon) dating from 1945 but is still popular today due to its simple structure and reliable operation. When the rifle trigger is pulled, the firing pin strikes the primer and ignites the gunpowder in the cartridge. The rapidly expanding propellant gases in the bullet are guided into the gas chamber above the barrel through a passage near the rifle muzzle. The pressurized gases in the gas chamber push the long-stroke piston with the bolt carrier backwards and the locking guide under the bolt carrier rotates the bolt together with the extractor pin on the bolt carrier guide and releases it. The spring for a reverse stroke of the bolt and the piston is mounted separately with its guide. A disadvantage of this rifle is that relatively large weights (piston and bolt carrier) are moving when firing, resulting in stronger recoils of the weapon. A further disadvantage lies in the fact that the propellant gases in the gas chamber, when they push the piston, exert force or a bending moment on the barrel, resulting in lower firing accuracy due to the barrel curvature.

US 2018/0259276 discloses a rifle in which the bolt carrier is separated from the gas chamber and gas piston. When the rifle is being cleaned, the gas piston is removed separately and is not part of the bolt as in the AK platform mentioned above. In this rifle, the gas chamber is also mounted above the barrel proximal to the rifle muzzle. Again, in this rifle, the propellant gases in the gas chamber exert force and a bending moment on the barrel, resulting in lower firing accuracy due to the barrel curvature. If the rifle barrel is formed with a thicker wall, the effect of bending of the barrel is reduced, but the weight of the rifle is greater, though. A further disadvantage is a large number of component parts, often small ones, getting lost or incorrectly assembled during maintenance and cleaning of the rifle.

U.S. Pat. No. 2,951,424 discloses a rifle based on the so-called Stoner's system. This rifle has a gas passage that directs the propellant gases from the rifle barrel directly to a barrel receiver, in which a bolt carrier and a bolt are mounted, the bolt being formed as a piston allowing for cyclical operation. An advantage of this rifle is the absence of loads on the rifle barrel during firing, resulting in a more accurate firing. The total weight of the rifle is also reduced. A disadvantage of this rifle lies in the fact that the gases are guided into the bolt carrier, which causes heating of the vital components, the components get dirty because of the propellant gases, which results in less reliable operation and requires frequent cleaning. Since excess gases are released through the cartridge ejection opening, this may be uncomfortable for left-handed shooters because the gases are sprayed into the face.

Technical Problem

The technical problem is how to configure a rifle that will have a low total weight, will provide accurate shooting, and will not cause strong recoils during firing.

Solution to the Technical Problem

Relative terms such as above, below, forward, backward, distal end, etc. are defined with respect to the user when the rifle is in the operating position.

The technical problem is solved with a rifle comprising at least:

a housing assembly comprising an upper and a bottom housing portion, a breech mechanism assembly arranged within the housing assembly and comprising a bolt carrier assembly which further comprises a bolt carrier and a guiding sleeve fixed in the upper portion of the bolt carrier, a bolt arranged in the bottom portion of the bolt carrier, a guiding pin arranged through the central portion of the bolt carrier, and a barrel receiver, a rifle barrel screwed into the barrel receiver and comprising a gas adapter at the distal end of the rifle barrel, and a self-loading mechanism comprising a gas chamber with a guiding tube connected to a gas adapter, and a piston assembly comprising an impact damper fixed within the housing assembly, a piston slidingly movable within the gas chamber, a guide fixed to the piston at one end and provided at its other end in the longitudinal direction of the guide with a blind hole, a fixed piston slidingly movable at one end within the blind hole of the guide and fixed to the impact damper at the other end, a helical spring arranged within the blind hole of the guide in a way to lean against the bottom of the blind hole of the guide with one end and connected to the fixed piston with its other end, a return helical spring arranged around the guide in a way to lean against a stop in the guiding sleeve with one end and against the impact damper with the other end, wherein the gas chamber is arranged on the rifle barrel in the area of the barrel receiver.

When using the rifle, the user pulls the trigger, thereby activating a hammer which strikes a firing pin which in turn hits a primer, thereby causing the ignition of the gunpowder in the cartridge. High-pressure propellant gases propel the bullet toward the rifle muzzle. As the bullet passes the gas adapter, the pressurized propellant gases expand through the guide tube into the gas chamber. Propellant gases push back the piston together with the guide and the breech mechanism assembly. The helical spring and the return helical spring become tensioned. When the pressure within the gas chamber is released, the helical spring pushes the guide together with the piston forward to the starting position, while the movement of the breech mechanism assembly backwards persists until the bolt extracts the cartridge case from the barrel. Once the cartridge case is ejected from the rifle, the return helical spring returns the breech mechanism assembly to its original position, with the bolt pushing a new cartridge into the rifle barrel.

The arrangement of the gas chamber on the rifle barrel closely next to the barrel receiver ensures that the rifle barrel does not bend. There are two reasons for it: The gas chamber causes substantially no bending moment on the rifle barrel when the piston is pushed. Another reason is that the gas chamber is arranged on the part of the rifle barrel, where the barrel is attached to the housing, i. e. at the thickened portion of the rifle barrel having better flexural strength. For these reasons, shooting is more accurate. An additional advantage is that due to the absence of bending forces on the rifle barrel, the remaining portion of the rifle barrel (i.e. outside the barrel mounting area) can be formed with a reduced thickness of the barrel wall, which significantly contributes to the lower total weight of the rifle.

The piston which pushes the breech mechanism assembly back performs only a jerk-like short stroke having a length of about 15 mm. The rest of the path for extracting the cartridge case is performed by the breech mechanism assembly itself, while the piston is already returning to its starting position, thus ensuring minimal mass movement and consequently reducing the rifle's recoils.

A further advantage of the rifle according to the invention is that the guide which is part of the piston assembly, guides the return helical spring, which makes the firing cycle more silent and the operation smoother.

In prior art rifles, the piston must be removed separately and it is therefore often inadvertently not maintained, although the piston is often the dirtiest part of the rifle.

If not properly cleaned and maintained, the piston in the gas chamber may be blocked. In the rifle according to the invention, the piston assembly is integrated in the breech mechanism assembly, which makes it impossible to forget to maintain the piston during the disassembly and maintenance of the rifle, which is yet another advantage of the rifle according to the invention over known rifles. The piston assembly according to the invention allows the use of barrels of different lengths depending on user's preferences, wherein only the length of the gas barrel needs to be adapted and not the structure of the piston assembly.

FIG. 1: Rifle in side view

Figure 2:
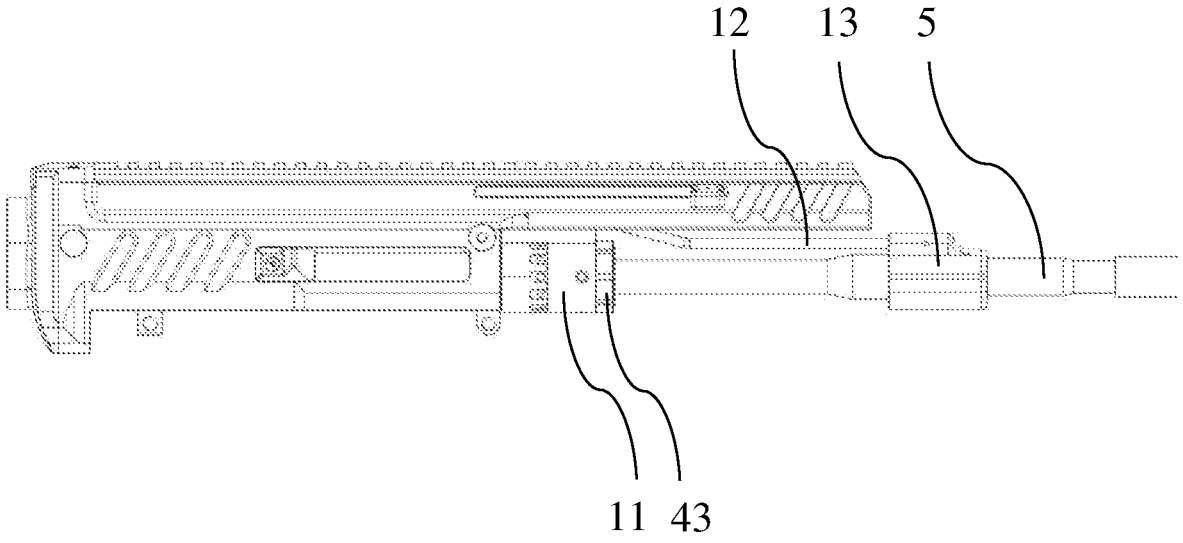

FIG. 2: Assembly of a housing with a barrel in side view

Figure 3:
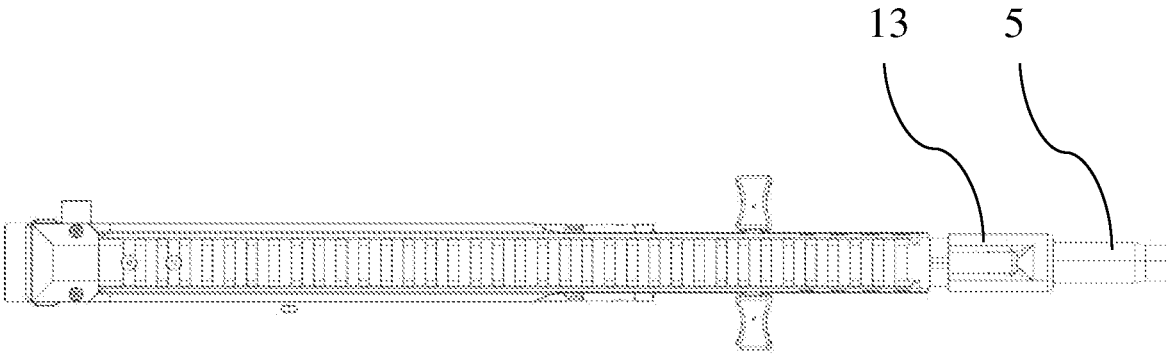

FIG. 3: Assembly of a housing with a barrel in top view

Figure 4:
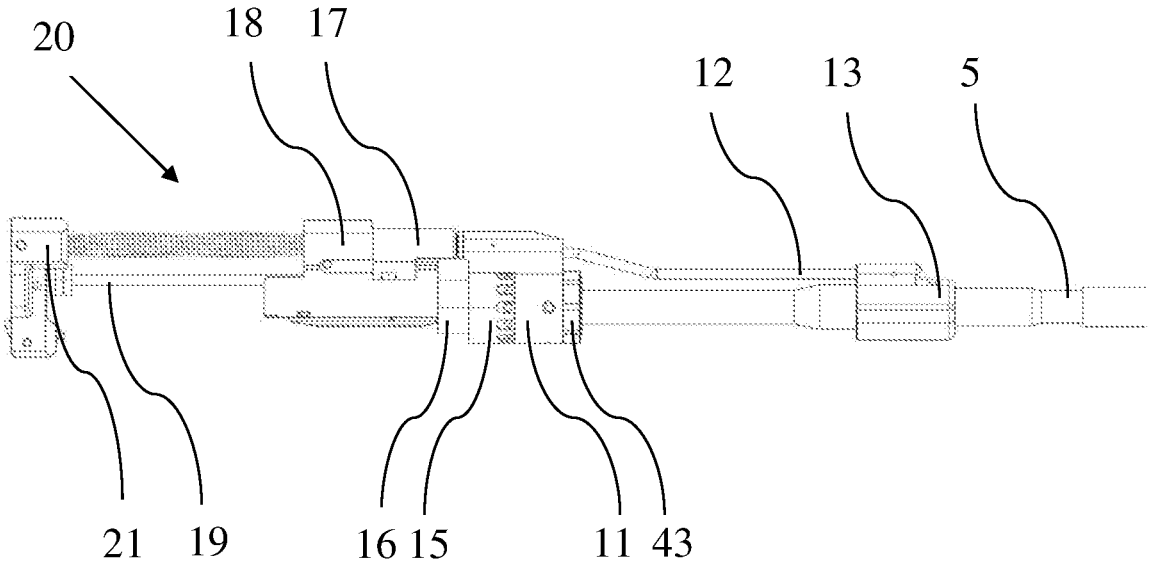

FIG. 4: Breech mechanism assembly with a barrel in side view

Figure 5:
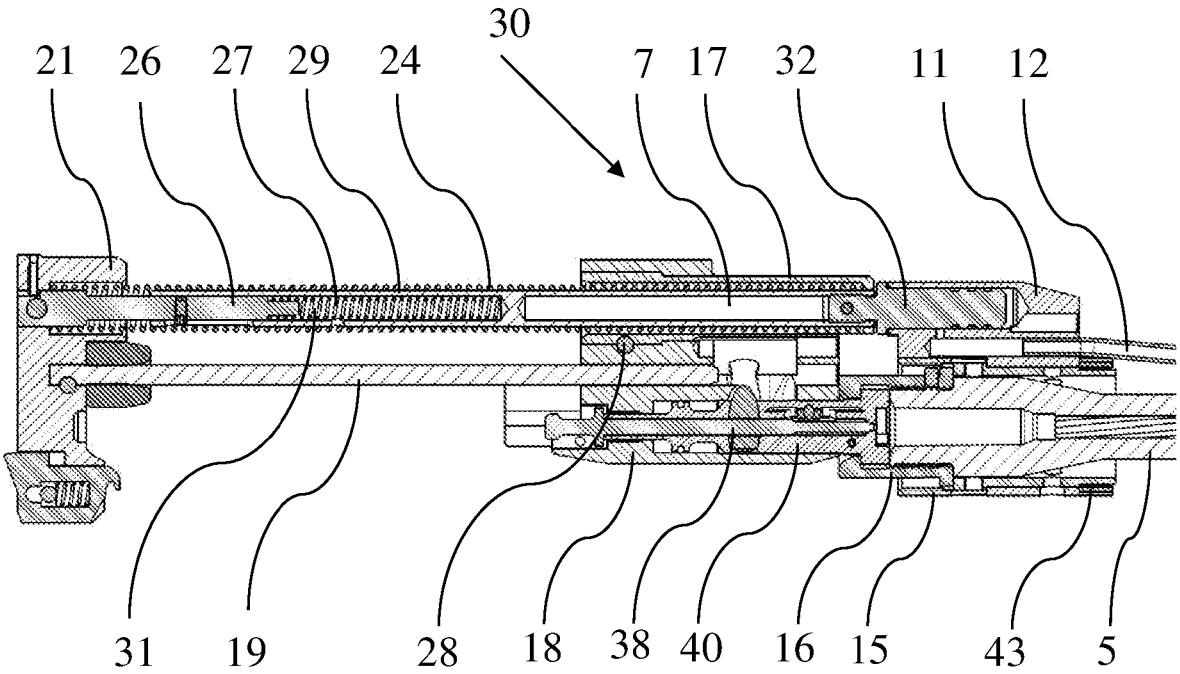

FIG. 5: Breech mechanism assembly with a barrel in cross-section

Figure 6:
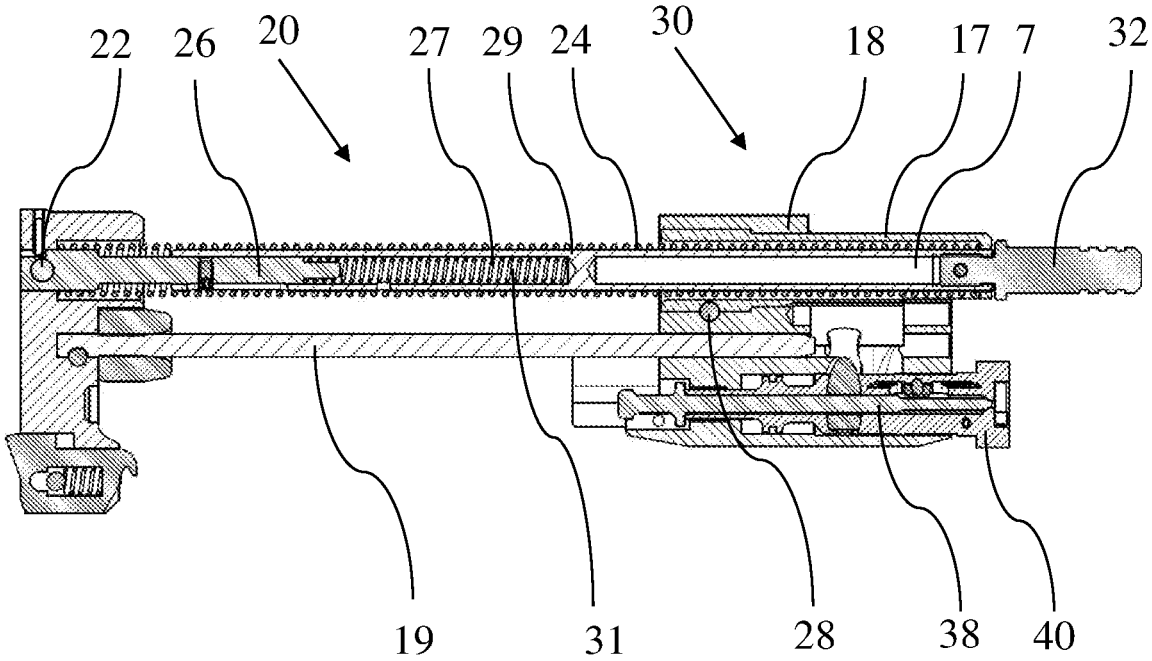

FIG. 6: Breech mechanism assembly without a barrel in cross-section

Figure 7:
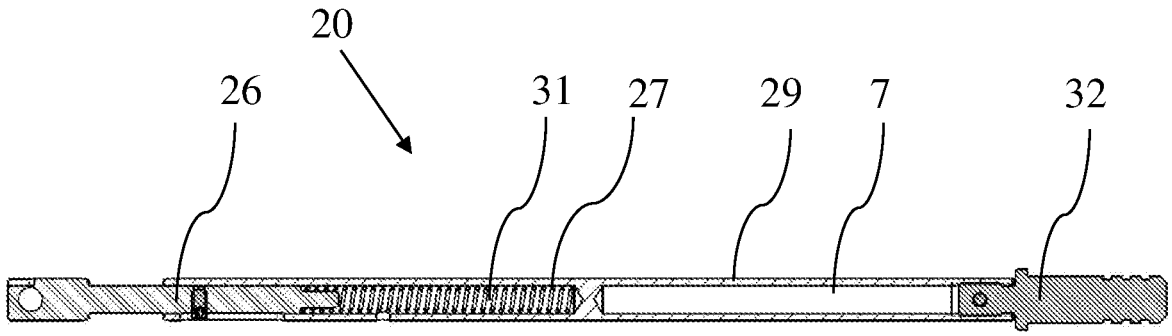

FIG. 7: Piston assembly in cross-section

Figure 8:
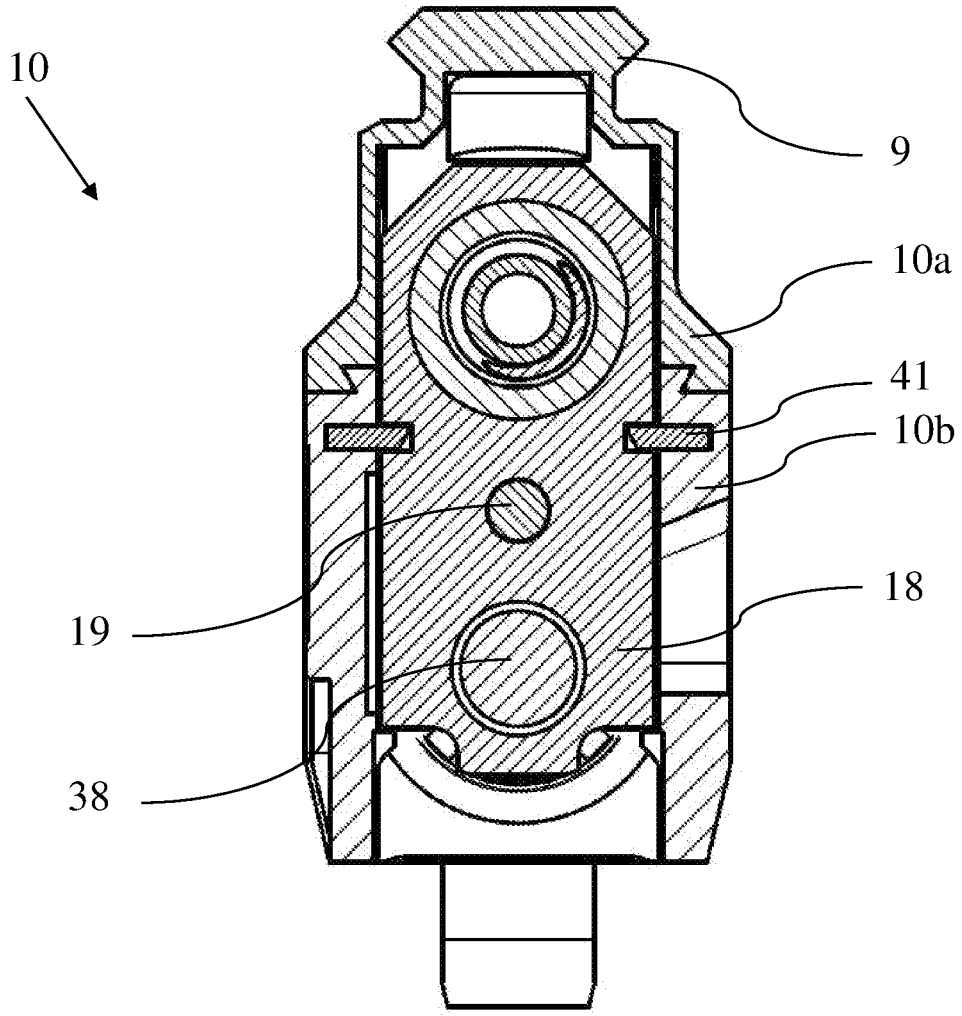

FIG. 8: Rifle in cross-section

LIST OF REFERENCE NUMERALS

1 rifle
2 butt
4 handguard
5 rifle barrel
7 cavity
9 accessory mounting bracket
10 rifle housing assembly
10*a* upper housing part
10*b* bottom housing part
11 gas chamber
12 guide tube
13 gas adapter
15 barrel nut
16 barrel receiver
17 guiding sleeve
18 bolt carrier
19 guiding pin
20 piston assembly
21 impact damper
22 first pin
24 return helical spring
26 fixed piston
27 helical spring
28 second pin
29 guide
30 bolt carrier assembly
31 blind hole
32 piston
38 firing pin
40 bolt
41 steel rail
43 safety nut The invention is described in more detail in the following.

The technical problem is solved with a rifle 1 comprising at least:

a housing assembly 10 comprising an upper 10*a* and a bottom housing portion 10*b*, a breech mechanism assembly arranged within the housing assembly 10 and comprising a bolt carrier assembly 30 which further comprises a bolt carrier 18 and a guiding sleeve 17 fixed in the upper portion of the bolt carrier, a bolt 40 arranged in the bottom portion of the bolt carrier, a guiding pin 19 arranged through the central portion of the bolt carrier, and a barrel receiver 16, a rifle barrel 5 screwed into the barrel receiver 16 and comprising a gas adapter 13 at the distal end of the rifle barrel 5, and a self-loading mechanism comprising a gas chamber 11 with a guiding tube 12 connected to the gas adapter 13, and a piston assembly 20 comprising an impact damper 21 fixed within the housing assembly 10, a piston 32 slidingly movable within the gas chamber 11, a guide 29 fixed to the piston 32 at one end and provided at its other end in the longitudinal direction of the guide with a blind hole 31, a fixed piston 26 slidingly movable at one end within the blind hole 31 of the guide and fixed to the impact damper 21 at the other end, a helical spring 27 arranged within the blind hole 31 of the guide in a way to lean against the bottom of the blind hole of the guide with one end and connected to the fixed piston 26 with its other end and a return helical spring 24 arranged around the guide 29 in a way to lean against a stop in the guiding sleeve 17 with one end and against the impact damper 21 with the other end, wherein the gas chamber 11 is arranged on the rifle barrel 5 in the area of the barrel receiver 16.

In the region where the piston 32 is fastened, the guide 29 is formed with a cavity 7 that reduces the weight of the piston assembly 20.

The fixed piston 26 of the piston assembly may be fixed in the impact damper 21 by means of a first pin 22.

The guiding sleeve 17 may be fixed within the bolt carrier 18 by means of a second pin 28 that fixes the position of the guiding sleeve within the bolt carrier.

The gas chamber 11 can be arranged on the rifle barrel by means of a barrel nut 15, on which it is mounted. The barrel nut 15 is mounted onto the barrel receiver 16. The position of the gas chamber 11 may be fixed on the barrel nut by means of a safety nut 43.

When using the rifle, the user pulls the trigger, thereby activating a hammer which strikes a firing pin 38 which in turn hits a primer, thereby causing the ignition of the gunpowder in the cartridge. High-pressure propellant gases propel the bullet toward the rifle muzzle. As the bullet passes the gas adapter 13, the pressurized propellant gases expand through the guide tube 12 into the gas chamber 11. Propellant gases push back the piston 32 together with the guide 29 and the breech mechanism assembly. The helical spring 27 and the return helical spring 24 become tensioned. When the pressure within the gas chamber 11 is released, the helical spring 27 pushes the guide 29 together with the piston 32 forward to the starting position, while the movement of the breech mechanism assembly backwards persists until the bolt 40 extracts the cartridge case from the barrel. Once the cartridge case is ejected from the rifle, the return helical spring 24 returns the breech mechanism assembly to its original position, with the bolt 40 pushing a new cartridge into the rifle barrel 5.

The housing assembly 10 comprises a bottom housing portion 10*b* and an upper housing portion 10*a*, said portions being connected by a dovetail. The housing is made of an aluminium material. In the bottom portion of the housing, steel rails 41 are arranged in the longitudinal direction of the rifle, which are fixed in the bottom part of the housing by means of standardized pins. The steel rails guide the bolt carrier 18. The steel rails are wear-resistant and provide good guiding of the bolt carrier and reliable operation of the ejection mechanism. The modular housing allows for the replacement of the upper housing portion by different lengths of rifle accessory mounting brackets, such as binoculars, sights, laser equipment, lights, etc.

The rifle can further comprise a butt 2 that is connected with the housing assembly 10. The rifle can further comprise a handguard 4.

The invention claimed is:

1. A rifle comprising:

a housing assembly comprising an upper and a bottom housing portion, a breech mechanism assembly arranged within the housing assembly and comprising a bolt carrier assembly which further comprises a bolt carrier and a guiding sleeve fixed in the upper portion of the bolt carrier, a bolt arranged in the bottom portion of the bolt carrier, a guiding pin arranged through the central portion of the bolt carrier, and a barrel receiver, a rifle barrel screwed into the barrel receiver and comprising a gas adapter at the distal end of the rifle barrel, and a self-loading mechanism comprising a gas chamber with a guiding tube connected to the gas adapter, and a piston assembly comprising an impact damper fixed within the housing assembly, a piston slidingly movable within the gas chamber, a guide fixed to the piston at one end and a return helical spring arranged around the guide in a way to lean against a stop in the guiding sleeve with one end and against the impact damper with the other end, characterized in that the guide is provided at its other end in the longitudinal direction of the guide with a blind hole, and the piston assembly further comprises a fixed piston slidingly movable at one end within the blind hole of the guide and fixed to the impact damper at the other end, a helical spring arranged within the blind hole of the guide in a way to lean against the bottom of the blind hole of the guide with one end and connected to the fixed piston with the other end, wherein the gas chamber is arranged on the rifle barrel in the area of the barrel receiver.

2. The rifle according to claim 1, characterized in that the upper and the bottom housing portions are connected by means of a dovetail.

3. The rifle according to claim 1, characterized in that the guide is formed with a cavity in the region of connection with the piston.

4. The rifle according to claim 1, characterized in that the gas chamber is arranged on the rifle barrel by means of a barrel nut, on which it is mounted.

5. The rifle according to claim 4, characterized in that the barrel nut is mounted onto the barrel receiver.

6. The rifle according to claim 4, characterized in that the position of the gas chamber is fixed on the barrel nut by means of a safety nut.

7. The rifle according to claim 1, characterized in that in the bottom housing portion, steel rails are arranged in the longitudinal direction of the rifle, which are fixed in the bottom housing portion by means of pins.

8. The rifle according to claim 1, characterized in that the fixed piston of the piston assembly is fixed in the impact damper by means of a first pin.

9. The rifle according to claim 1, characterized in that the guiding sleeve is fixed within the bolt carrier by means of a second pin.

* * * * *